US005161723A

United States Patent [19]

Wirtz-Odenthal

[11] Patent Number: 5,161,723

[45] Date of Patent: Nov. 10, 1992

[54] DISPENSER FOR PAYING OUT SECTIONS OF A WEB OF MATERIAL FROM A DISPENSER ROLL

[75] Inventor: Bernhard Wirtz-Odenthal, Korschenbroich, Fed. Rep. of Germany

[73] Assignee: Scott-Feldmuhle GmbH, Dusseldorf, Fed. Rep. of Germany

[21] Appl. No.: 780,244

[22] Filed: Oct. 22, 1991

[30] Foreign Application Priority Data

Oct. 30, 1990 [DE] Fed. Rep. of Germany ..... 4034504

[51] Int. Cl.[5] ..... A47K 10/36; B65H 35/06

[52] U.S. Cl. ..... 225/14; 225/15; 225/20; 225/77

[58] Field of Search ..... 225/10, 12, 13, 14, 225/15, 20, 77, 82; 242/55.53

[56] References Cited

U.S. PATENT DOCUMENTS

| | | | |
|---|---|---|---|
| 2,121,346 | 6/1938 | Harvey | 225/14 |
| 2,193,759 | 3/1940 | Birr | 225/14 |
| 3,221,586 | 12/1965 | Bahnsen . | |

FOREIGN PATENT DOCUMENTS

| | | |
|---|---|---|
| 1554565 | 4/1970 | Fed. Rep. of Germany . |
| 2804555 | 8/1978 | Fed. Rep. of Germany . |
| 2836709 | 3/1980 | Fed. Rep. of Germany . |
| 3049840 | 3/1981 | Fed. Rep. of Germany . |
| 3705808 | 9/1988 | Fed. Rep. of Germany . |
| 409286 | 3/1966 | Switzerland . |

*Primary Examiner*—Hien H. Phan

*Attorney, Agent, or Firm*—Brumbaugh, Graves, Donohue & Raymond

[57] ABSTRACT

The dispenser has a housing (42) which comprises a roll holder for the dispenser roll (39) and an outlet opening (55). A stationary knife (12) projects out of the outlet opening (55). An apportioning roller (1) is supported in the housing (42) in the path of the web of material (39) from the dispenser roll (38) to the outlet opening (55); it is adapted for stepwise rotation and to be arrested in a certain angular position by a control lever (15) so as to define a section length of the web of material (39). The knife (12) normally is covered by a cover strip (10) adapted to be moved away from the knife (12) by pulling at the web of material (39). The cover strip (10) is connected to the control lever (15) in such manner that the latter releases the apportioning roller (1) whenever the web of material (39) has been severed.

8 Claims, 7 Drawing Sheets

Figure 1:
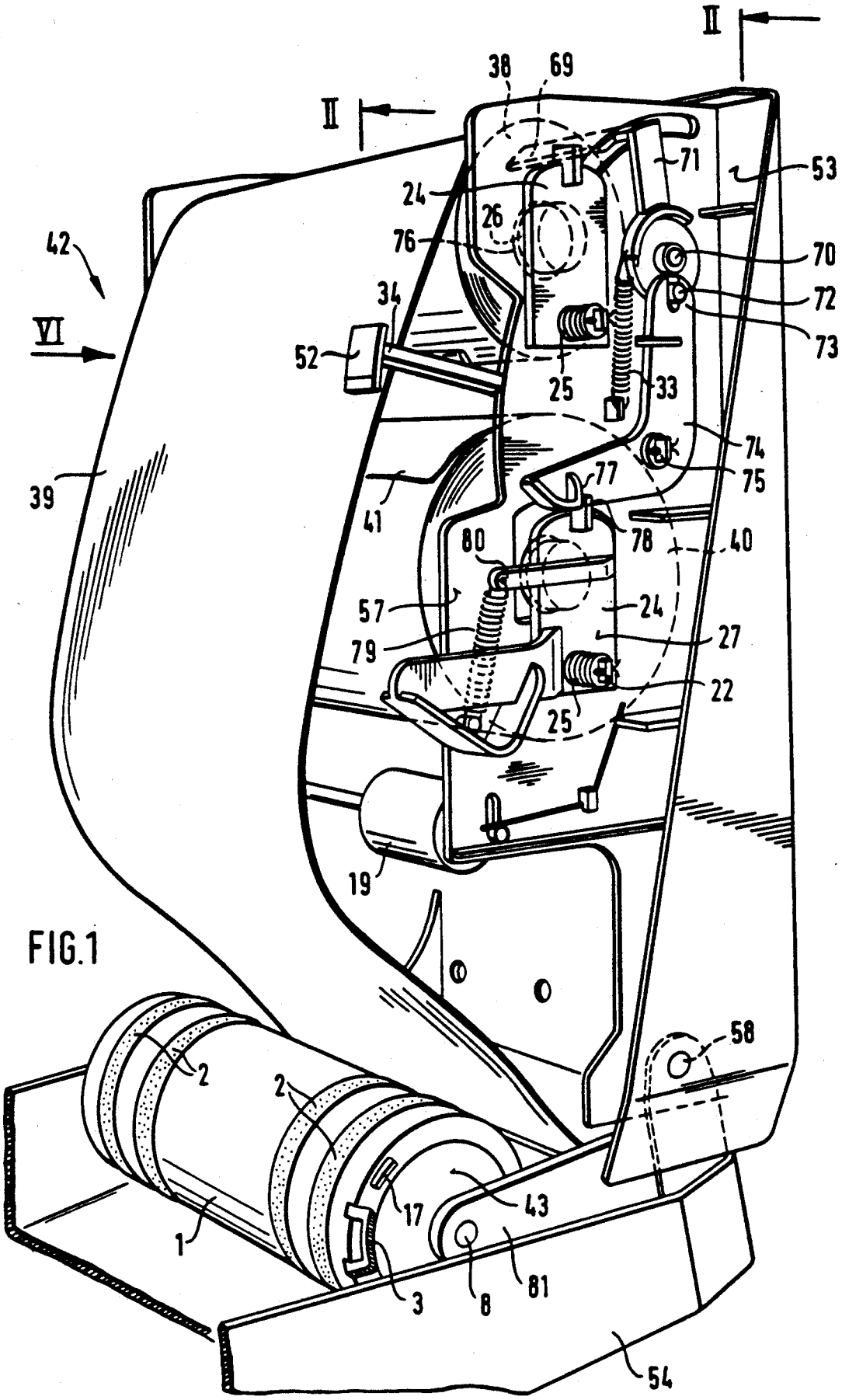

FIG. 8
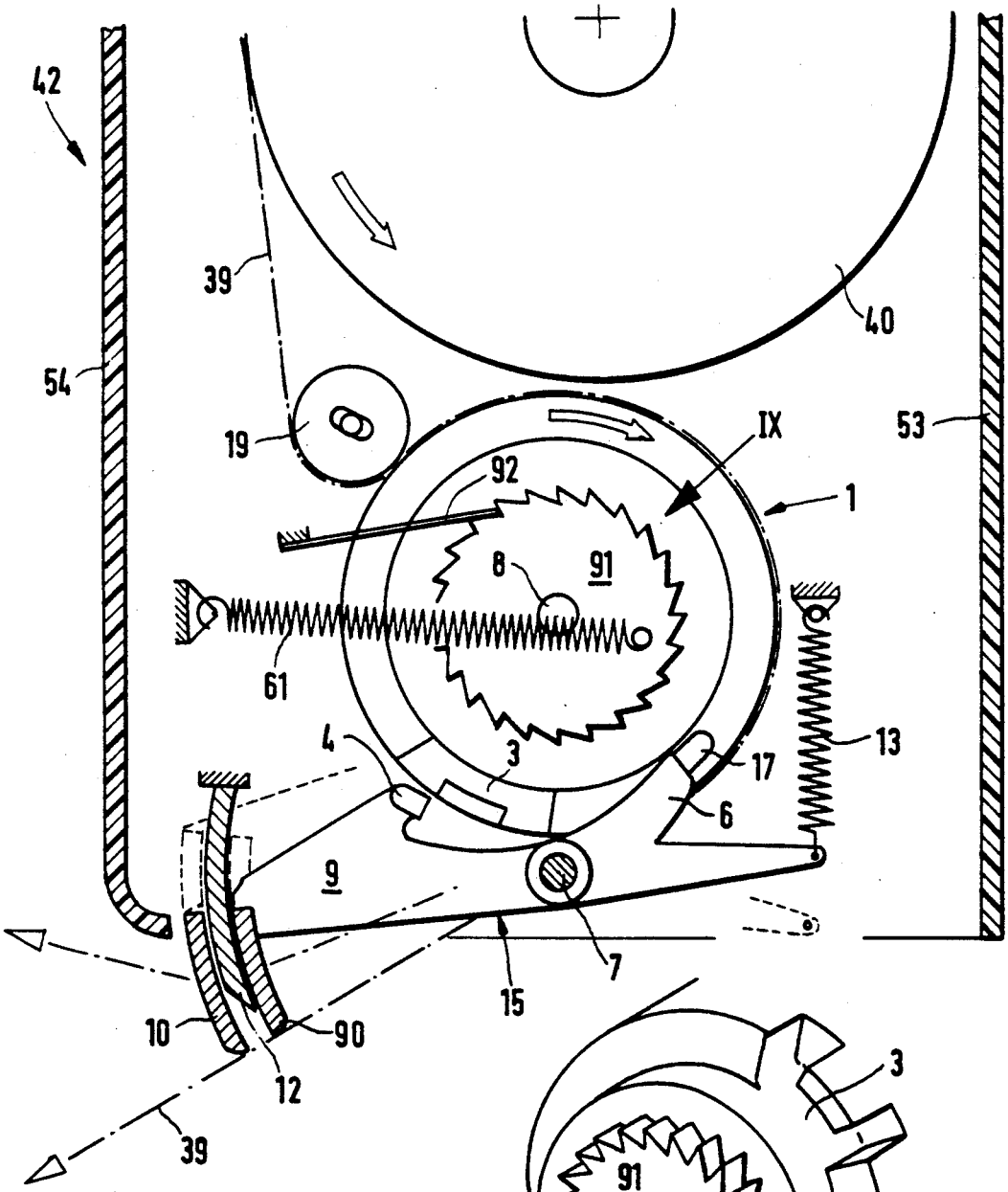
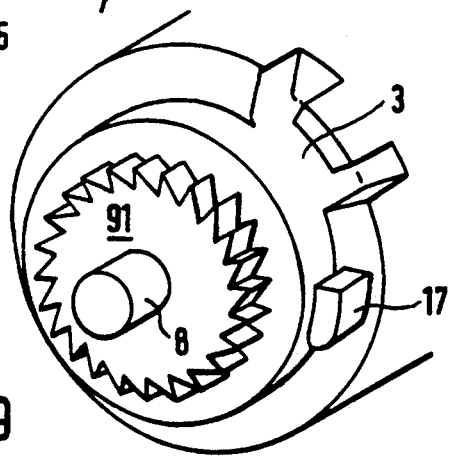
FIG. 9

DISPENSER FOR PAYING OUT SECTIONS OF A WEB OF MATERIAL FROM A DISPENSER ROLL

The invention relates to a dispenser, especially a dispenser of paper towels with which web sections of defined length can be pulled off a dispenser roll and severed at a knife.

In the case of known paper towel dispensers the user grasps the protruding leading end of the paper web, usually with both hands, and pulls a length off the dispenser roll. Dispensers generally are designed so that only a certain length can be pulled off, whereupon the paper web is arrested. Thereupon the user can draw the paper web against a knife disposed at the dispenser so as to cut off the length he has withdrawn. The knife, usually having sharp edge teeth, is located near the leading end of the web which hangs out of the dispenser. For this reason there is a risk that the user will get hurt by the knife when he grasps the leading end of the web.

A foil dispenser is known from DE 30 49 840 C2 having a housing with an outlet opening adjacent which an electrically heatable wire functions as a foil cutter. The wire normally is covered by a plate-like drop shutter so that the user, when reaching for the leading edge of the foil to pull out a length of foil, will not get his fingers burnt easily by the wire.

Another foil dispenser is known from DE 28 04 555 A1. In that case a knife to cut off the foil is disposed on a carriage which normally is in an inoperative position, keeping the knife under a cover. The foil is passed over guide pulleys supported on the carriage so that a user, pulling at the leading end of the foil, can draw the carriage into a position in which the knife is exposed to cut the foil. Together with the knife, the carriage returns automatically from this position into the inoperative position.

Another dispenser for foil or paper web sections is known from DE 37 05 808 A1. The dispenser includes a housing in which a knife is supported for swinging motion and under the control of a spring-loaded thrust member. The web of material is passed over the thrust member in such a manner that the knife is not swung out of the housing unless the thrust member is displaced by the web of material being pulled off.

It is not excluded with a sufficient degree of certainty with any of these known dispensers that hurried or unskilled users, above all children, will not suffer injuries from the cutting device. That is true in particular of those dispensers which are provided with movable cutter means whose more or less abrupt exiting from the housing may catch the user by surprise.

It is, therefore, the object of the invention to make a dispenser for paying out sections of a web of material from a dispenser roll safer still, without substantially increasing the structural expenditure involved in moving parts.

In accordance with the invention, a dispenser by which the above object is met, comprises the following:

- a housing which includes a roll holder for the dispenser roll and an outlet opening,
- a stationary knife projecting out of the outlet opening,
- an apportioning roller which is supported in the housing in the path of the web of material from the dispenser roll to the outlet opening and is rotatable stepwise,

- a control lever adapted to stop the apportioning roller in a certain angular position so as to define a length to be cut off from the web of material, and
- a cover strip which normally covers the knife, being movable away from the knife by pulling at the web of material, and is connected to the control lever in such a way that the latter releases the apportioning roller each time the web of material is severed.

With the dispenser according to the invention, the user may grasp the leading end of the web which hangs out of the outlet opening by both hands without running any risk since the knife is covered by the cover strip and consequently cannot be touched by the hands. The cover strip preferably is locked in this position so that it cannot be moved away from the knife accidentally. The cover strip is not released until the web of material has been unwound to the full length of one section of the web so that the user's hands will be located at a greater distance from the knife. Then the web of material enters into engagement with the knife. The cover strip automatically returns into the position in which it covers the knife as soon as the web of material has been cut.

The cover strip preferably is connected to the control lever simply by being fastened to a carrier arm of the control lever.

It is convenient for the control lever to have a stop arm and normally to be kept by a return spring in a position in which a stopper provided at the apportioning roller abuts against the stop arm.

Moreover, the control lever preferably comprises a guide arm for engagement in a guide means provided at the apportioning roller to permit limited rotation of the apportioning roller when the control lever has been swung, against the force of the return spring, by a force acting from the web of material on the cover strip, so as to assume a position in which the stop arm releases the stopper.

The guide means may be embodied by a U-shaped groove formed in an end face of the apportioning roller.

The apportioning roller preferably is connected to a cam drive which converts the force of a transport spring into a forward rotatory moment acting on the apportioning roller whenever the guide arm engages in the guide means. In this manner, each time a web section has been cut off, the web of material is advanced automatically by a certain distance so as to be ready to be grasped on the occasion of the next use.

Protection from injury can be enhanced still further with the dispenser according to the invention by providing two cover strips for the control lever, with the knife positioned between them.

It is advantageous in this context if the control lever has a pivot axis extending parellel to the apportioning roller and if the knife as well as both cover strips are curved coaxially around the pivot axis.

Figure 2:
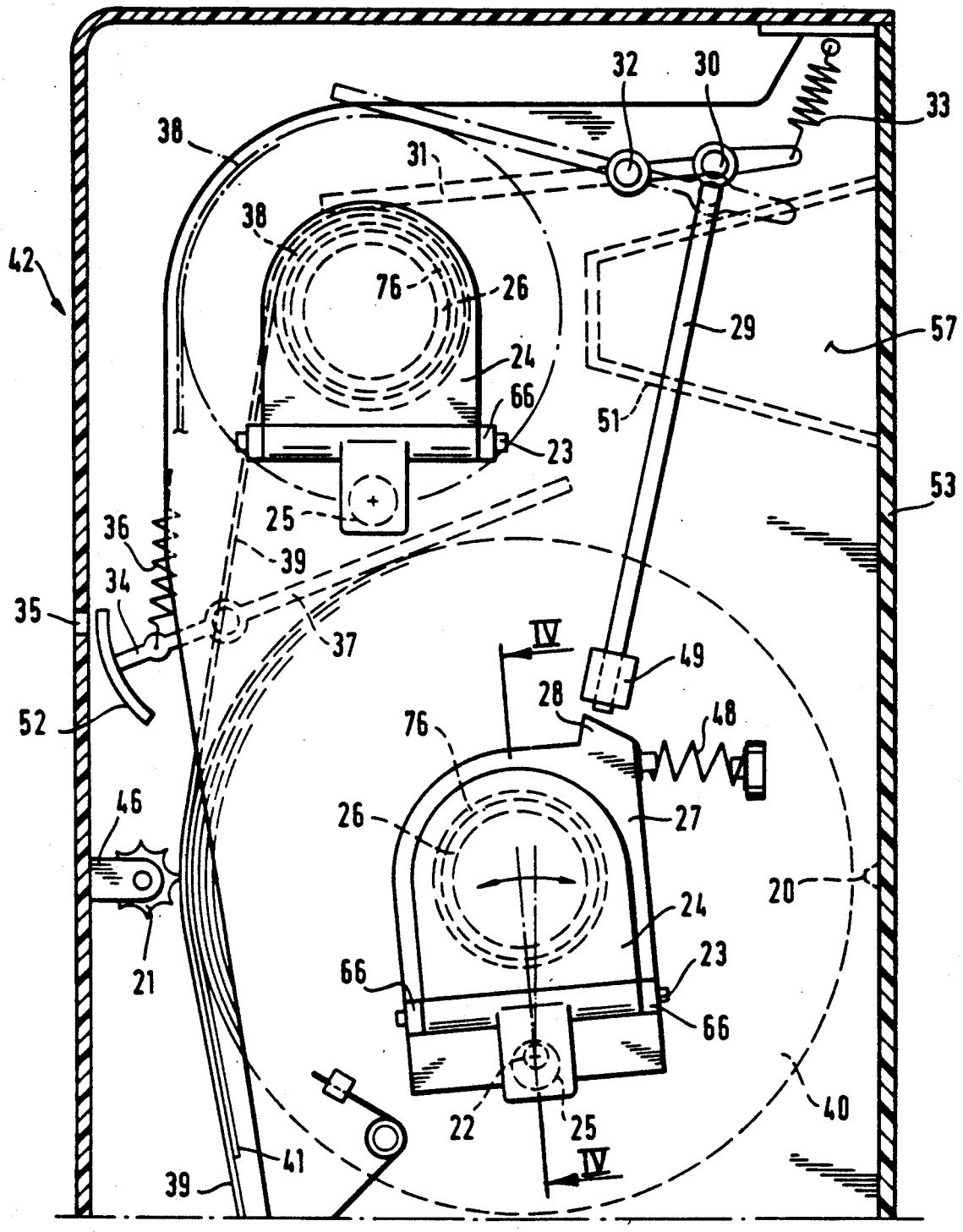
Figure 3:
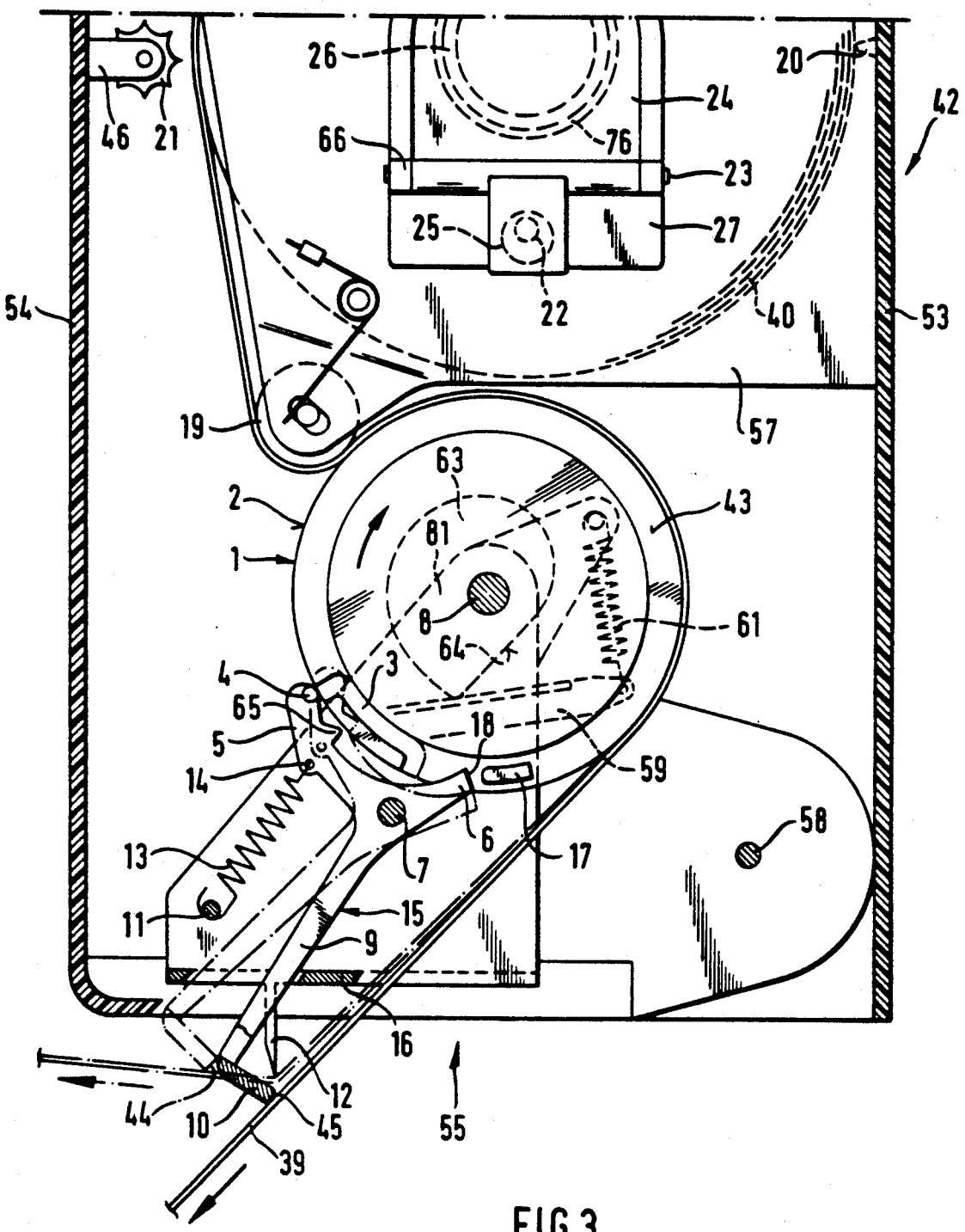
Figure 4:
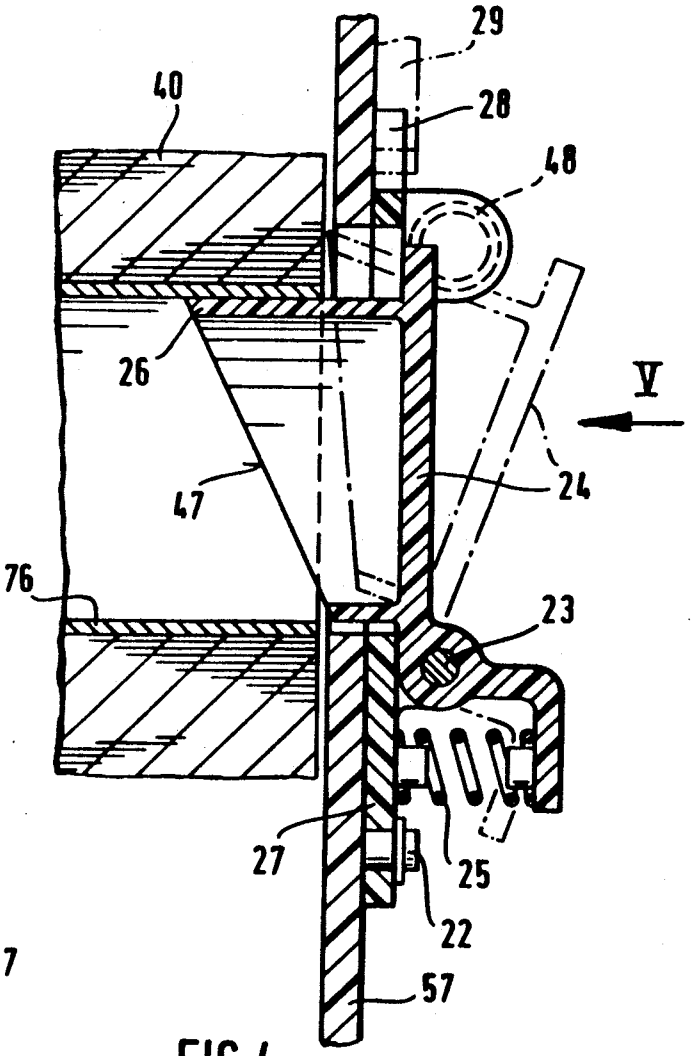
Figure 5:
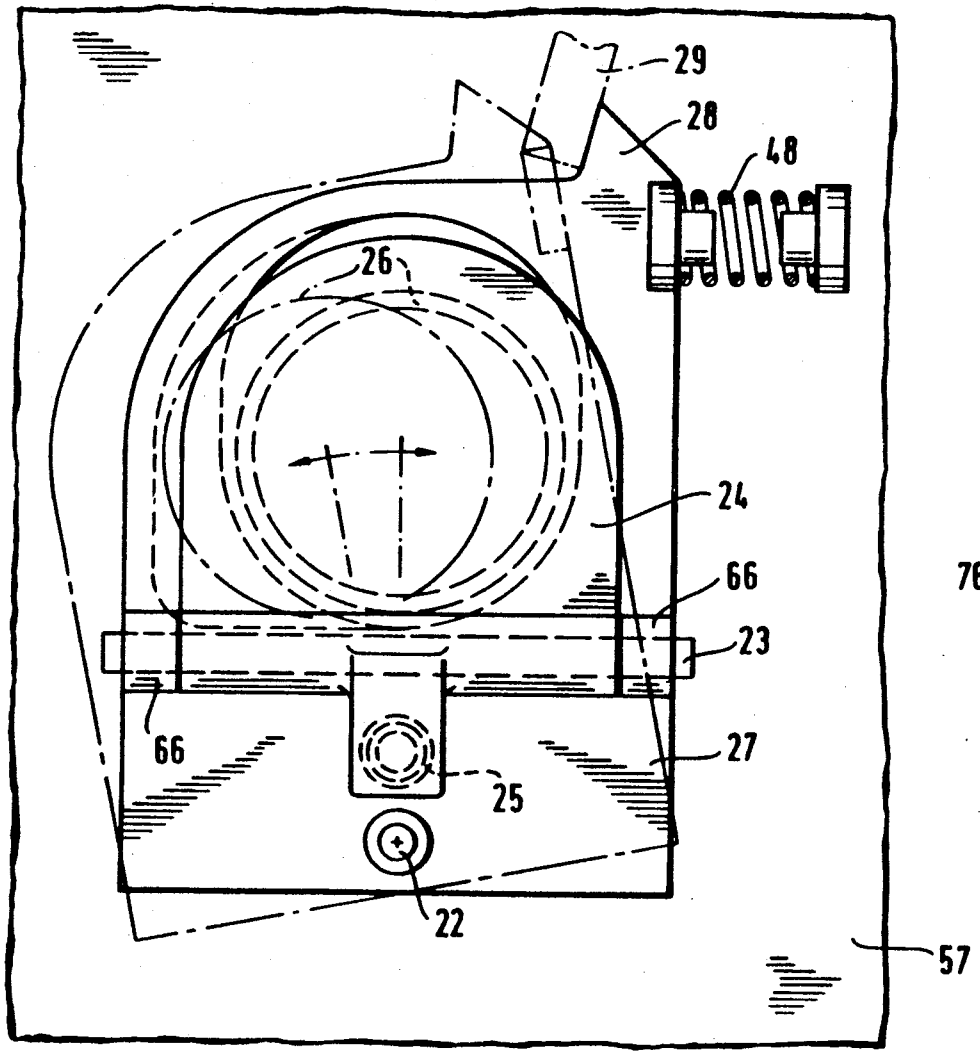
Figure 6:
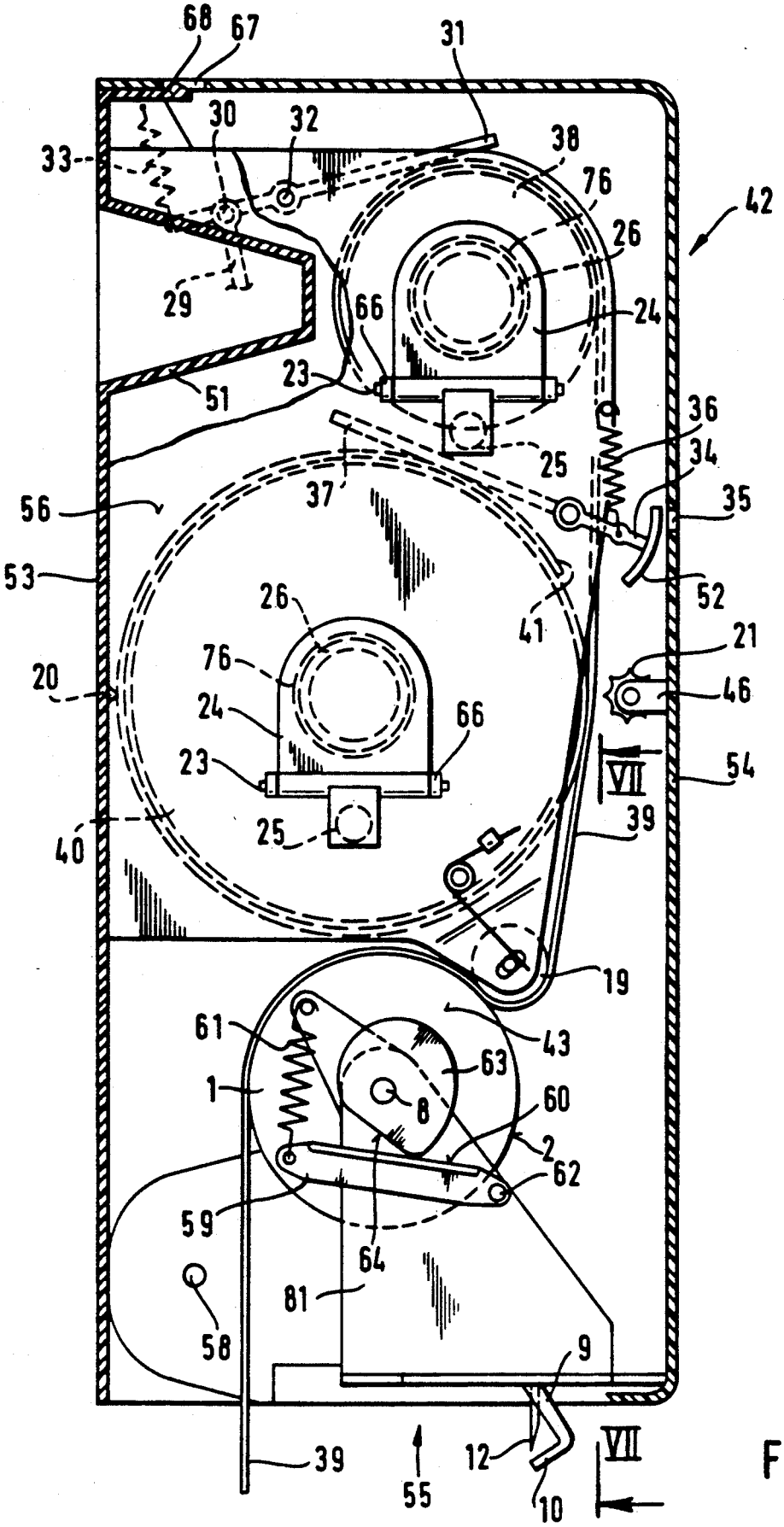
Figure 7:
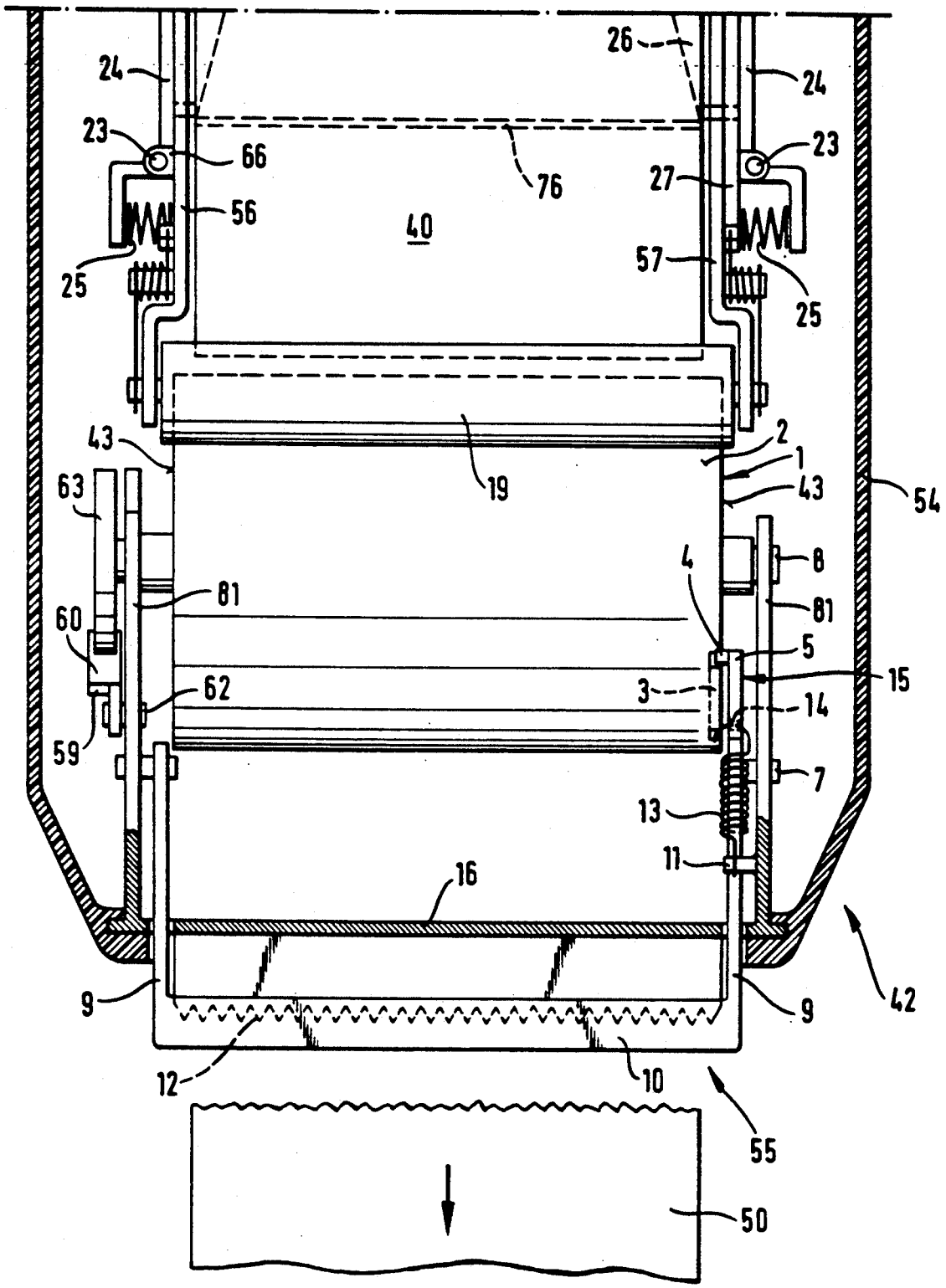

The invention will be described further, by way of example, with reference to the accompanying drawings, in which:

FIG. 1 is a perspective view of a dispenser in opened state,

FIG. 2 shows the upper part of vertical section II—II of FIG. 1, with the dispenser closed and ready to be operated, FIG. 3 shows the lower part of the same section, FIG. 4 presents section IV—IV of FIG. 2 on an enlarged scale, FIG. 5 is the lateral view V of FIG. 4, FIG. 6 is the side elevation in the direction of arrow VI in FIG. 1 partly drawing as a vertical section, FIG. 7 shows vertical section VII—VII of FIG. 6, FIG. 8 is a part sectional view corresponding to FIG. 3 of a modified dispenser, and FIG. 9 is an inclined view of a detail in the direction of arrow IX in FIG. 8.

The dispenser illustrated in FIGS. 1 to 7 comprises a housing 42 which is adapted to be opened hingedly and suitable for mounting on the wall of a building or the like. A dispenser roll 38 rests on supporting studs 26 in the upper part of the housing 42. The dispenser roll 38 contains a web of material 39, for instance a paper web. Each supporting stud 26 consists of a pipe end which is given a downward slope and presents an integral part of an upper tilting bearing 24 pressed through a right or left inside wall 56, 57, respectively, of the housing 42 by a contact pressure spring 25 and connected to the same in a manner so as to be pivotable in and out by means of a swing bolt 23. The swing bolt 23 is received in solid journal bearings 66 formed at the inside walls 56, 57.

A space of the width of the dispenser roll 38 is defined between the inside walls 56 and 57. The dispenser roll 38 includes a winding tube 76 and is inserted from below along the slope 47 of the supporting studs which thus tilt outwardly until the contact pressure springs 25 press the supporting studs 26 into the winding tube 76. A limiter 51 is formed a the back wall 53 of the housing 42 to define the space available such that only dispenser rolls 38 having a defined maximum diameter can be introduced.

A feeler 31 rests on the dispenser roll 38; it consists of a two-armed lever supported on a bearing bolt 32 and is held in contact position on the dispenser roll by a feeler spring 33. A joint pin 30 connects the feeler 31 with a rod 29 which is guided in a rod guide member 49. The lower end of the rod 29 is in engagement with a detent 28 of a swinging plate 27 which is pivotable about a pivot pin 22 and carries one of two lower tilting bearings 24.

As the web of material 39 is pulled out from the dispenser roll 38 the diameter of the latter decreases so that the front part of the feeler 31 continually moves downward, whereby the rod 29 is pulled upward until it releases the detent 28 when the dispenser roll 38 is almost empty. Thereupon a spring 48 moves the swinging plate 27, together with the lower tilting bearing 24 mentioned, in the direction of a toothed roller 21 which is is supported in a toothed roller block 46.

At both its ends a spare or supply roll 40 rests in the lower tilting bearings 24. Only one of these lower tilting bearings 24 is located on the swinging plate 27, i.e. the supply roll 40 is pressed one-sidedly by the spring 48 against the toothed roller 21, thus being swung away from a brake 20. The brake 20 consequently no longer engages the circumference of the supply roll 40 which, therefore, can rotate freely.

The toothed roller 21 presses the web of material 39 coming from the dispenser roll 38 against the supply roll 40 so that the leading end 41 thereof is payed out from the supply roll 40 together with the web of material 39 being withdrawn, reaches contact pressure rollers 19, and gets to the outlet opening 55 of the dispenser by being guided over an apportioning roller 1. Friction linings 2 on the apportioning roller 1 are coordinated with the contact pressure rollers 19 so that the web of material 39 moves without slip over the apportioning roller 1.

For some time now, two webs of material are being dispensed simultaneously, i.e. when the web of material 39 is torn off at the knife 12 two web sections 50 are removed. This doubling of the web of material 39 lasts until the upper dispenser roll 38 is exhausted which means that from two to five double sheets are payed out before unwinding takes place from the supply roll 40 alone.

A filling level lever 34 loaded by a spring 36 rests on the supply roll 40 by way of a filling level feeler 37. The housing 42 comprises a front wall 54 which can be tilted forwardly and includes a window 35 through which a scale 52 on the filling level lever 34 is visible. The filling level of the dispenser thus can be observed from outside. The scale 52 is designed such that an alarm is given as early as when two thirds of the supply roll 40 have been used up. If the dispenser is refilled in this condition the supply roll 40, now partly unwound, is exchanged for the empty winding tube 76 of the dispenser roll 38, and a new supply roll 40 is introduced into the dispenser.

Other than illustrated in FIGS. 2 to 6, the release mechanism for positioning the supply roll 40 may be designed as shown in FIG. 1, namely:

The dispenser roll 38 is sensed by a slide piece 69 which rests on the dispenser roll. The slide piece 69 forms an integral member with a flat lever 71 which is rotatable about a pin 70 and includes a peg 72 at its end opposite the slide piece 69. The peg 72 engages in a control fork 73 of an L-shaped lever 74 which is supported on a supporting pin 75 at the right inside wall 57 of the housing 42. The front arm of the L-shaped lever 74 includes a hook-shaped stop 77 which snaps into engagement behind a protrusion 78 of the lower tilting bearing 24 arranged further down on the swinging plate 27.

As the web of material 39 is unwound from the upper dispenser roll 38 the diameter of the latter decreases so that the slide piece 69 moves in the direction of the winding tube 76. Hereby the flat lever 71 rotates so that its peg 72 moves the control fork 73 in the direction of the back wall 53 of the housing 42, thereby rotating the L-shaped lever 74 so as to lift the stop 77 over the protrusion 78. A tension spring 79 connects a point of the right inside wall 57 to a arm 80 of the swinging plate 27 or of the lower tilting bearing 24, thereby pulling the supply roll 40 against the toothed roller 21.

As shown in FIGS. 2 to 6, the toothed roller 21 sits in the toothed roller block 46 which forms an integral component part of the front wall 54. The front wall 54 is supported in bearings 58 in the right and left inside walls 57, 56 and has a holding slit 67 in its upper portion near the back wall 53 to be engaged by a resilient hook 68 disposed at the back wall 53 (FIG. 6).

The apportioning roller 1 is supported between bearing blocks 81 in the lower part of the front wall 54, thus being swung forwardly when the front wall 54 is tilted forwardly so that the web of material 39 can be passed conveniently between the contact pressure rollers 19 and the apportioning roller 1 upon roll replacement. The bearing blocks 81 are interconnected by a link 16 at which the knife 12 is formed. A bolt 7 supporting a three-armed control lever 15 is fixed at one of the bearing blocks 81. The control lever 15 has a guide arm 5 formed with a hole 14 in which one end of a return spring 13 is hooked up, the other end being hooked to a retainer pin 11 in the front part of the bearing block 81.

Pulling off the web of material 39 causes rotation of the apportioning roller 1 until a stopper 17 provided at an end surface 43 of the apportioning roller 1 hits against a stop 18 provided at a stop arm 6 of the three-armed control lever 15. This terminates the rotation of the apportioning roller 1 and consequently also the paying out of the web of material 39. The tension now occurring in the web of material 39 presses the web against a cover strip 10 formed at a carrier arm 9 of the control lever 15.

The carrier arm 9 thus is pivoted in clockwise sense in FIG. 3, in other words towards the user. Before the stop 18 releases the stopper 17, a guide pin 4 provided on the guide arm enters into a guide 3 embodied by a U-shaped groove 3 formed at the end surface 43 of the apportioning roller 1. This brings the carrier arm 9 into a release position 44 in which it frees the knife 12. At the same time, a nose 65 formed at the guide arm 5 snaps into a recess provided in the apportioning roller 1, whereby the latter is prevented from further rotation.

The apportioning roller 1 comprises two axle journals 8, one of which extends through the associated bearing block 81 and, at its outer end, carries a cam segment 63 formed with a flat portion 64. As shown in FIGS. 6 and 7, the cam segment 63 engages a slide surface 60 of a transport lever 59 supported on a pin 62 at bearing block 81 and pressed against the cam segment 63 by a transport spring 61. When the web of material 39 is withdrawn and, consequently, the apportioning roller 1 rotates, the cam segment 63 is rotated at the same time, i.e. the slide surface 60 which lies on the flat portion 64 when the apportioning roller 1 is at rest slides along the circumference of the cam segment 63 and moves the transport lever 59 down, thus tensioning the transport spring 61. The apportioning roller 1 is arrested at the moment when the maximum tensioning of the transport spring 61 is reached. That is effected by its stopper 17 abutting against the stop 18 of the three-armed control lever 15.

When the web of material 39 has been torn off, i.e. at a time when the carrier arm 9 is held by the guide pin 4 in the U-shaped groove 3 and the stopper 17 no longer touches the stop 18, the transport spring 61 pulls back the transport lever 59 into its inoperative position, thereby rotating the apportioning roller 1 until the guide pin 4 has once again left the U-shaped guide 3 and, therefore, the carrier arm 9 has led the cover strip 10 back over the knife 12. The cover strip 10 thus has returned into its starting position 45 and a fresh piece of the web of material 39 has been transported to the outside, ready to be grasped.

FIGS. 8 and 9 show an embodiment which differs from the dispenser described with reference to FIGS. 1 to 7 in that another cover strip 90, in addition to cover strip 10, is fastened to the carrier arm 9 of the control lever 15, these two cover strips receiving the knife 12 between them. The knife 12 and the two cover strips 10 and 90 are curved cylindrically and the axis of this curvature coincides with the pivot axis 7 of the control lever 15. The stationary knife 12 is positioned at a very small radial distance from both cover strips 10 and 90, just enough to give the two cover strips sufficient room for their swinging motion about the pivot axis 7.

Instead of the cam drive illustrated in FIGS. 1 to 7, including the transport lever 59, transport spring 61, and cam segment 63, the cam drive means according to FIG. 8 simply is obtained by the transport spring 61 being attached eccentrically to a ratchet gear 91 which is firmly connected to the apportioning roller 1. This eccentric drive still has the effect that the apportioning roller 1 is moved on directly, through an angle determined by the length of the guide 3 as measured in circumferential direction, as soon as the web of material 39 has been cut at the knife 12. Therefore, a fresh section of the web of material 39 is advanced so that it will hang out from the bottom of the housing 42, somewhat as shown in FIG. 6, ready for easy grasping.

A resilient pawl 92 engages in the ratchet gear 91 in such a way as to prevent any backward rotation of the apportioning roller 1.

What is claimed is:

1. A dispenser for paying out sections of a web of material (39) from a dispenser roll (38), comprising a housing (42) which includes a roll holder for the dispenser roll (38) and an outlet opening (55), a stationary knife (12) projecting out of the outlet opening (55), an apportioning roller (1) which is supported in the housing (42) in the path of the web of material (39) from the dispenser roll (38) to the outlet opening (55) and is rotatable stepwise, a control lever (15) adapted to stop the apportioning roller (1) in a certain angular position so as to define a length to be cut off from the web of material (39), and a cover strip (10) which normally covers the knife (12), is movable away from the knife (12) by pulling at the web of material (39), and connected to the control lever (15) in such a way that the latter releases the apportioning roller (1) each time the web of material (39) is severed.

2. The dispenser as claimed in claim 1, characterized in that the cover strip (10) is fastened at a support arm (9) of the control lever (15).

3. The dispenser as claimed in claim 2, characterized in that the control lever (15) comprises a stop arm (6) and is normally held by a return spring (13) in a position in which a stopper (17) disposed at the apportioning roller (1) abuts against the stop arm (6).

4. The dispenser as claimed in claim 3, characterized in that the control lever (15) further comprises a guide arm (5) engaging in a guide means (3) formed at the appportioning roller (1) and permitting limited rotation of the apportioning roller (1) whenever the control lever (15) has been pivoted by a force exerted on the cover strip (10) by the web of material (39), contrary to the force of the return spring (13), into a position in which the stop arm (6) releases the stopper.

5. The dispenser as claimed in claim 4, characterized in that the guide means (3) is embodied by a U-shaped groove at an end face (43) of the apportioning roller (1).

6. The dispenser as claimed in claim 4 or claim 5, characterized in that the apportioning roller (1) is connected to a cam drive which converts the force of a transport spring (61) into a forward rotary moment of force acting on the apportioning roller (1) when the guide arm (5) engages in the guide means (3).

7. The dispenser as claimed in any one of claims 1 to 5, characterized in that said cover strip comprises two cover members (10, 90) between which the knife (12) is disposed are coordinated with the control lever (15).

8. The dispenser as claimed in claim 7, characterized in that the control lever (15) has a pivot axis (7) in parallel with the apportioning roller (1) and the knife (12) as well as both cover strips (10, 90) are curved coaxially around the pivot axis (7).

* * * * *